United States Patent [19]

Lemin

[11] 4,350,121

[45] Sep. 21, 1982

[54] ANIMAL HANDLING APPARATUS

[76] Inventor: Norman P. Lemin, Purton Rd., Pakenham, Victoria, 3810, Australia

[21] Appl. No.: 171,467

[22] Filed: Jul. 23, 1980

[30] Foreign Application Priority Data

Jul. 25, 1979 [AU] Australia ..... PD9702

[51] Int. Cl.[3] ..... A61D 3/00

[52] U.S. Cl. ..... 119/103

[58] Field of Search ..... 119/98, 99, 103

[56] References Cited

U.S. PATENT DOCUMENTS

| | | | |
|---|---|---|---|
| 1,342,893 | 6/1920 | Block | 119/103 |
| 2,737,153 | 3/1956 | Dupont et al. | 119/103 |
| 3,026,846 | 3/1962 | Emmelkamp | 119/103 |
| 3,276,433 | 10/1966 | Tougas et al. | 119/103 |
| 3,319,608 | 5/1967 | Klooster | 119/103 X |
| 3,941,095 | 3/1976 | Hamilton et al. | 119/103 |
| 4,123,993 | 11/1978 | Whiteley | 119/103 |
| 4,162,685 | 7/1979 | Knappenberger | 119/103 |

FOREIGN PATENT DOCUMENTS

| | | | |
|---|---|---|---|
| 222923 | 7/1959 | Australia | 119/103 |
| 1063446 | 10/1979 | Canada | 119/103 |

*Primary Examiner*—Gene Mancene
*Assistant Examiner*—Robert P. Swiatek
*Attorney, Agent, or Firm*—Scully, Scott, Murphy & Presser

[57] ABSTRACT

Animal handling apparatus comprising a base, an animal cage mounted on the base for rotation about a generally vertical axis, and wherein the animal cage includes a portion adapted to hold the animal thereto and which is pivotable about a generally horizontal axis to give access to the ventral portion of the animal.

9 Claims, 8 Drawing Figures

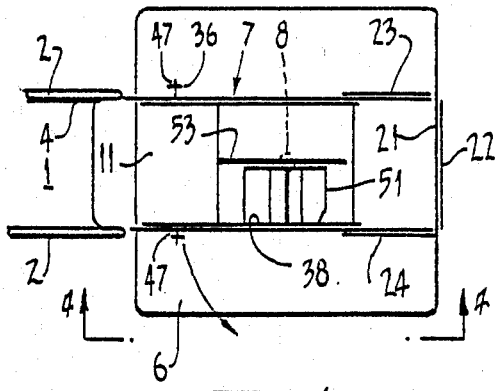
FIG. 1.
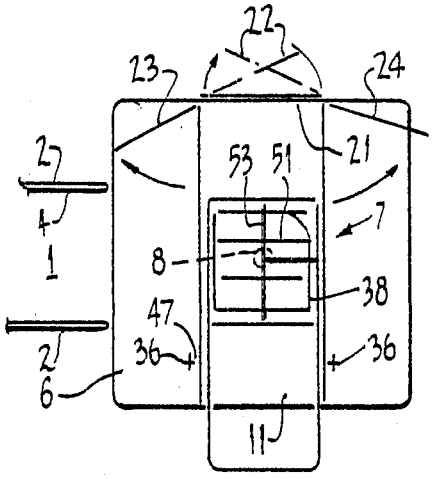
FIG. 2.
FIG. 7.
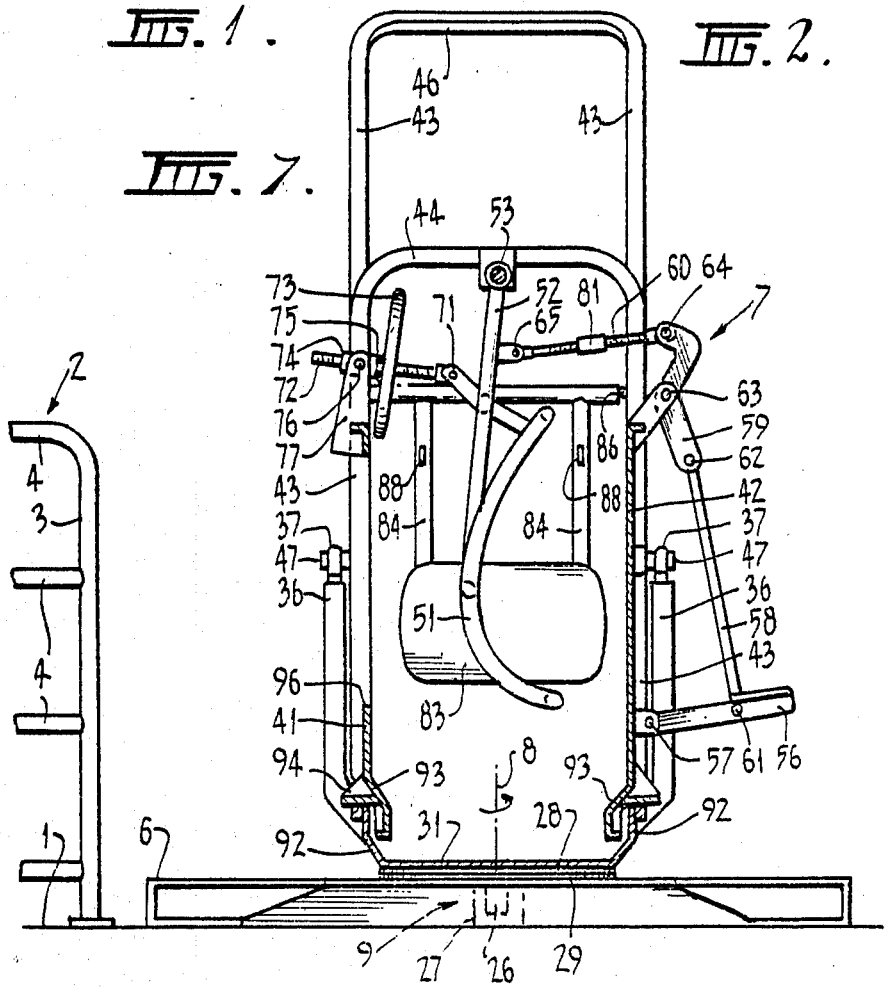

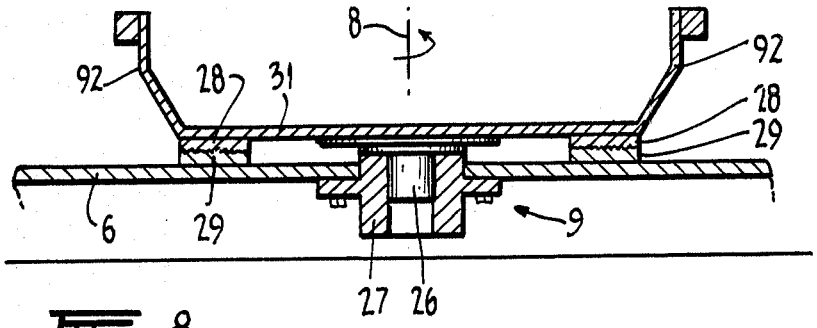
FIG. 8.
FIG. 6.
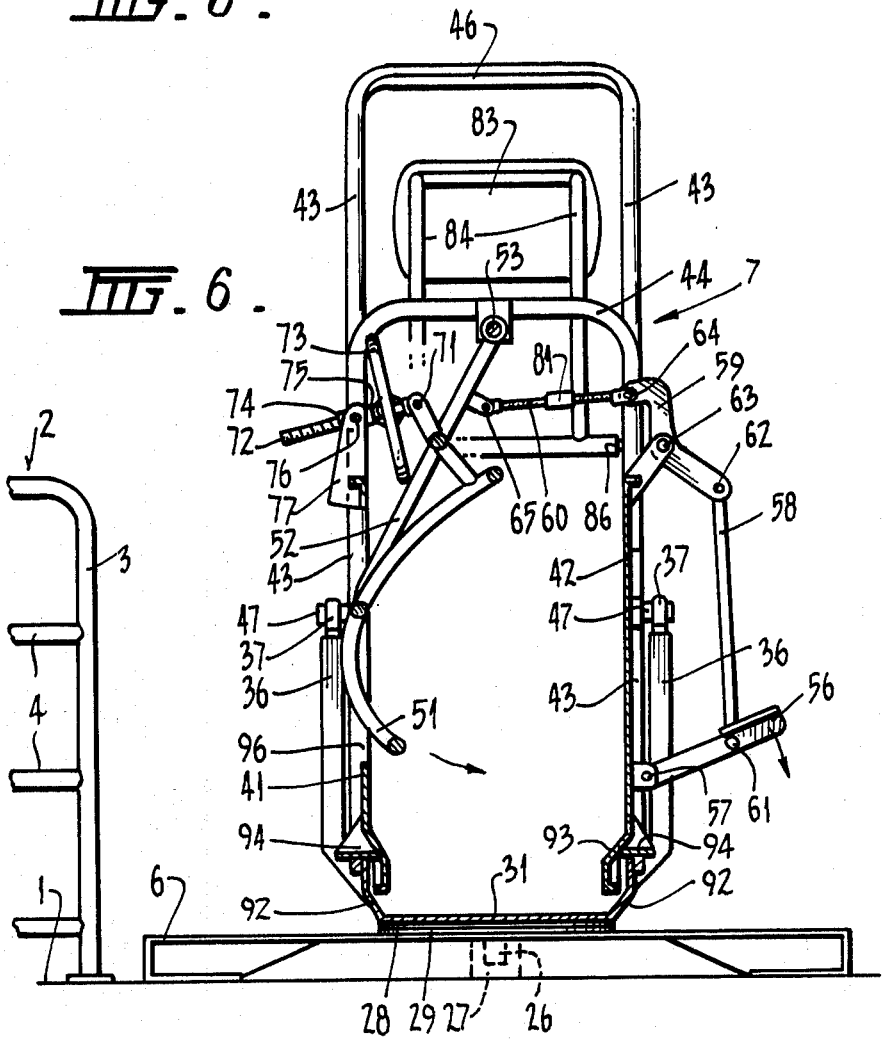

ANIMAL HANDLING APPARATUS

This invention relates to animal handling apparatus.

The present invention provides animal handling apparatus comprising a base, an animal cage mounted on the base for rotation about a generally vertical axis, and wherein the animal cage includes a portion adapted to hold the animal thereto and which is pivotable about a generally horizontal axis to give access to the ventral portion of the animal.

The animal cage may be constructed so that said portion can depress an animal below the horizontal.

Preferably the animal cage has two opposite ends one end of which is normally open to provide access for an animal and which is provided with a support which is movable from a position in which it does not obstruct said one end to a position in which it obstructs said one end and can act as a support for an animal when said portion is pivoted about said generally horizontal axis to give access to the ventral portion of an animal.

The support is preferably in the nature of a seat which is mounted to move from an upper, non-obstructing position to a lower obstructing and supporting position. Means for releasably locking the support in its upper and lower positions are preferably provided.

Preferably the other end of the animal cage has a closable opening through which an animal can egress.

Preferably the animal cage has sides extending between said one end and said other end and wherein said sides are provided with openings to give access to an animal. Said openings are preferably closable such as by doors.

The apparatus will find particular application when in association with a race adapted to lead animals to said one end when the animal cage is in a particular relatively rotated orientation with respect to said generally vertical axis.

Preferably said portion includes a support movable generally transversely of the animal cage and adapted to force an animal against one of said sides and to support the ventral region of an animal as said portion is pivoted about said generally horizontal axis.

Preferably said support has first and second actuating mechanisms for moving it generally transversely of the animal cage and wherein the first mechanism comprises a foot operated pedal which, when released, will free the support against forcing an animal against one of said sides and the second mechanism comprises means for maintaining an animal forced against said one of said sides without operator assistance.

A neck restraint collar for an animal may be included.

The lower portion of the cage preferably tapers or is stepped inwardly as this will help to restrict damage to an animal's feet or legs.

Said generally horizontal axis may be movable longitudinally of the apparatus.

Said generally horizontal axis is desirably so positioned that a struggling animal cannot upset balance and return itself to the horizontal position.

A specific construction of animal handling apparatus in accordance with this invention will now be described with the aid of the accompanying drawings in which:

FIG. 1 is a schematic plan view of the apparatus in one position,

FIG. 2 is a schematic plan view of the apparatus in another position,

FIG. 6 is a cross-section on line 6—6 in FIG. 4, FIG. 7 is a view similar to FIG. 6 but shows parts in a different position, and FIG. 8 is a cross-section through part of the apparatus.

Figure 3:
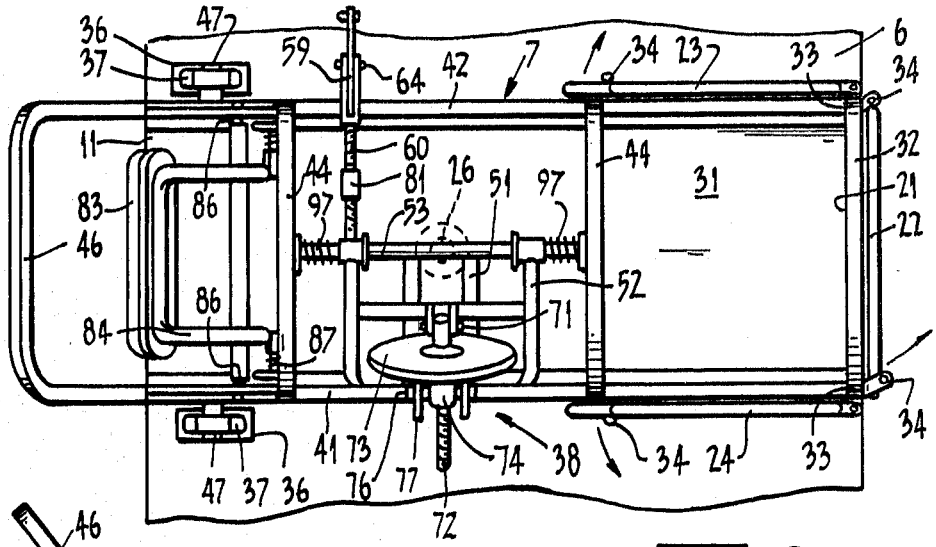
FIG. 3 is a plan view of the apparatus.

The apparatus shown in the drawings comprises a race 1 having a floor which may be the ground and two side panels 2 made up of posts 3 and rails 4, a base 6 and an animal cage 7 mounted on the base to pivot about a vertical axis 8 on a bearing 9. The cage 7 is open at one end 11, is closed at the opposite end 21 by a door 22 which may be left or right hand opening or able to be opened both left and right handedly and has doors 23 and 24 at its sides.

Because of the ability of the cage 7 to pivot about the axis 8 an animal may pass through the race, through the end 11 into the cage 7, be inspected, treated or otherwise dealt with, and then the cage may be pivoted about the axis 8 to enable the animal to return to the race. Alternatively, the animal might exit via one of the doors 22–24 with the cage 7 in any selected pivoted position including the positions shown in FIGS. 1 and 2.

The bearing 9 comprises a post 26 extending below the cage 7 which enters a bearing sleeve 27 carried by the base 6 and bearing pads 28 and 29 carried by the cage 7 and base 6.

The cage 7 comprises a base 31 to which the post 26 is secured, a rail 32, upright posts 33 to which the doors 22–24 are secured, releasable latches 34 for the doors 22–24, pillars 36 which support bearing sleeves 37 and an animal tilting mechanism 38.

The mechanism 38 comprises side panels 41 and 42, posts 43 which are secured to the panels 41 and 42, rails 44, a handle 46 and pivot pins 47 which are located in the sleeves 37. By pulling on the handle 46 the mechanism can tilt about the sleeves 37 from the position shown in FIG. 6 to that shown in FIG. 5 and FIG. 2 in which latter position it can be supported by the handle 46.

For the purpose of restraining an animal for whatever desired purpose and particularly when the mechanism 38 is to be tilted the cage 7 is provided with an animal restraint comprising a curved frame 51 mounted on arms 52 which are pivotally mounted on a rod 53 to move between the positions shown in FIGS. 6 and 7. Two mechanisms are provided for moving the frame 51; one comprises a foot operable pedal actuator 56 which is pivoted at 57 and which is connected to the arms 52 via linkages 58, 59 and 60 and pivots 61, 62, 63, 64 and 65, and the other comprises a pivot 71, screw 72, threaded wheel 73, having a bearing surface 75 which bears on a sleeve 74 into which the screw 72 enters, pivot pins 76 for pivotally supporting the sleeve 74, and supports 77 for the pins 76.

The mechanism comprising the pedal actuator 56 is primarily intended for temporary restraint of an animal but by the use of an over-the-centre mechanism among its linkages it could serve as a longer term restraint. It is to be noted that the linkage 60 comprises a left hand and a right hand screw and a turnbuckle body 81 for adjustment purposes.

The mechanism comprising the wheel 73 is intended for long term restraint and delicate adjustment can be had by delicate turning of the wheel 73.

Figure 4:
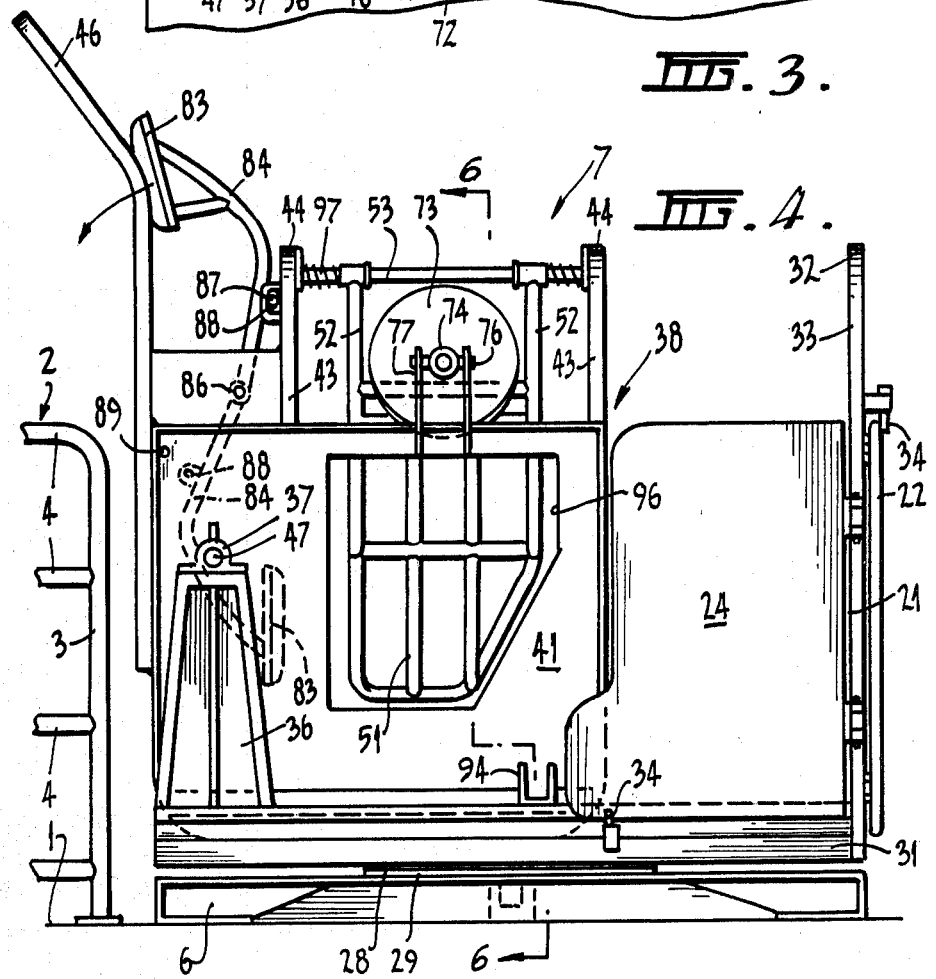
FIG. 4 is a side elevation of the apparatus.

A seat means and rearward restraint for an animal is provided and comprises a seat 83 mounted on arms 84 and which arms 84 pivot about a rod 86. Bolts 87 and pads 88 are provided to hold the seat 83 in an upper position (shown in full line in FIG. 4) and a pin, not shown, can be inserted through holes 89 in the side panels and through the pads 88 to hold the seat 83 in a lower position (approximately shown in dash line in FIG. 4).

Other constructional features of the apparatus include that the base 31 has upstanding sidewalls 92 and may have upstanding end walls so as to act as a trough. The side panels 41 and 42 have inwardly directed lower ends 93 which will assist in ensuring that an animal's legs are not caught between the lower ends 93 and sidewalls 92 as the mechanism 38 is returned to the horizontal from the FIG. 5 position. The side panels 41 and 42 also carry abutments 94 which serve to define the horizontal position of the mechanism 38 shown in FIG. 4 but if those abutments are made removable or adjustable it will be possible to depress the mechanism 38 below the horizontal if this should be desired.

The frame 51 will support the ventral surface of an animal and will press on one side to force the animal against the side panel 41 for that reason the side panel 42 does not have an opening corresponding to the opening 96 in panel 41 but as additional access to the animal may be required such an opening may be provided but if provided it is preferred that it is closable by a door or like.

The frame 51 is urged towards the FIG. 6 position by springs 97.

Various modifications can be made to the above described apparatus. For instance, the frame 51 may swing from right to left with respect to FIG. 6 instead of as shown; that is, the apparatus may be mirror imaged in construction to what is shown. Pneumatic or hydraulic means may be provided to move the frame 51 or to tilt the mechanism 38.

The pillars 36 or the sleeves 37 may be made longitudinally movable to provide adjustment to suit different sized animals.

Figure 5:
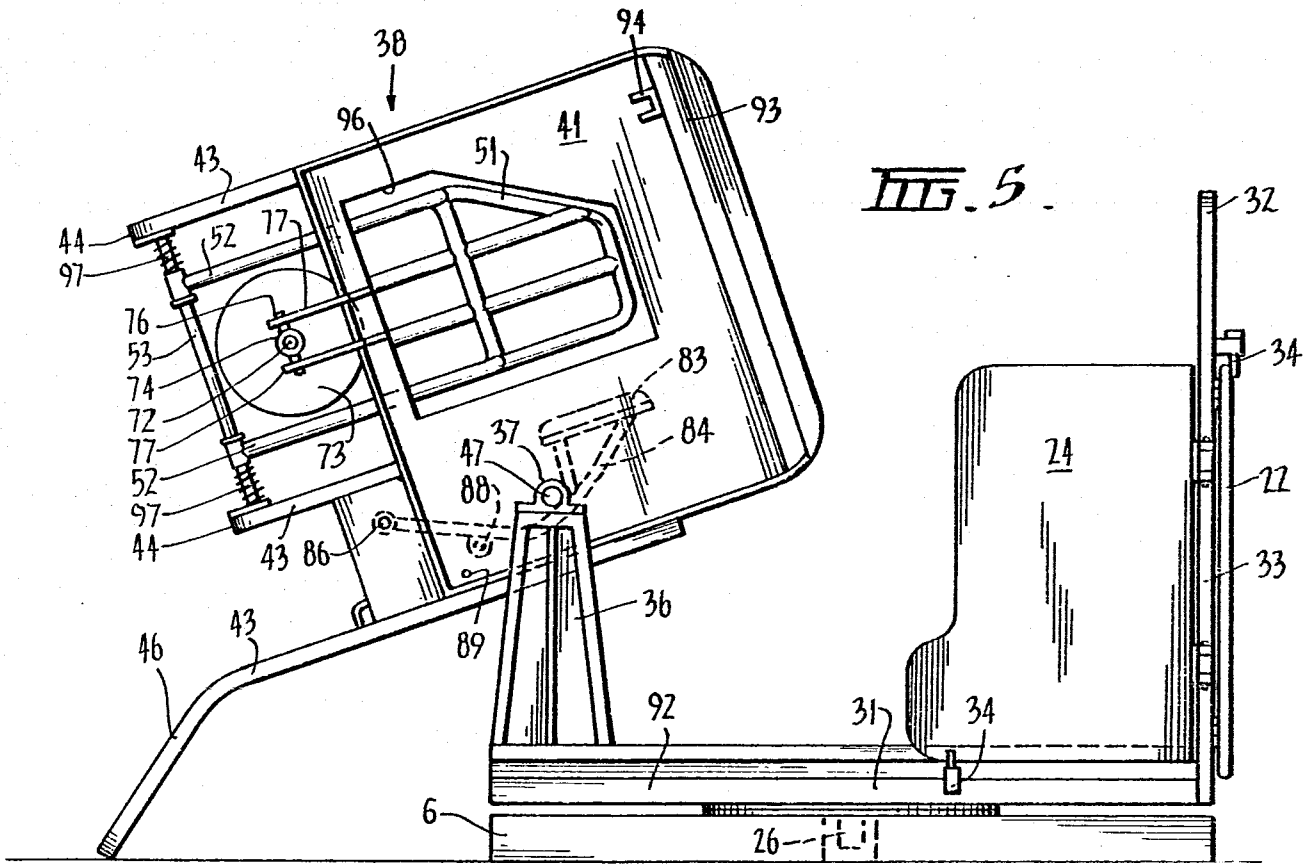
FIG. 5 is another side elevation of the apparatus showing a part in a position different to that of FIG. 4.

The handle 46 may have wheels so that the cage 7 can be turned about the axis 8 when in the FIG. 5 position.

A collar for restraining the neck of an animal may be provided.

Wheels may be provided beneath the base 6.

The above described apparatus will find a variety of uses. Firstly, it may be used as a race. It can also be used for simple inspection of animals one at a time and if desired the animal can be restrained. The doors and openings allow access to an animal's head, mouth and face, forelegs, flanks, hindquarters and dorsal region and if the mechanism 38 is tipped access to the animal's feet and ventral region can be had.

The apparatus will be useful to farmers, veterinarians, zoologists and researchers who use animals and may be used for animal husbandry, veterinarian, medical or sample taking purposes.

The apparatus will find primary use in respect of economic and domestic animals such as sheep, pigs, goats, cattle and horses but may be used with many other animals.

The apparatus may be made in different sizes to suit different sized animals although applying spacer blocks to the base 31 to effectively raise the height of the base 31 and to the panel 42 or to the frame 51 to effectively reduce the internal width of the apparatus may be found useful.

The claims form part part of the disclosure of this specification.

Modifications and adaptations may be made to the above described without departing from the spirit and scope of this invention which includes every novel feature and combination of features disclosed herein.

I claim:

1. Animal handling apparatus including a base, a floor for supporting an animal in a normal upright position, said floor being mounted on the base for rotation about a substantially vertical axis, an animal cage including sides and means for holding an animal, said animal cage being open at the bottom and being mounted to the floor to be pivotable as a whole about a substantially horizontal axis to turn an animal from a normal upright position to give access to the ventral portion of the animal; and said animal cage having two opposite ends, one of which is normally open to provide access for the animal and which is provided with a support for the buttocks of the animal which is movable from a position in which it does not obstruct said one end to a position in which it obstructs said one end and acts as a support for the buttocks of the animal when said animal cage is pivoted about said substantially horizontal axis to give access to the ventral portion of the animal.

2. Animal handling apparatus as claimed in claim 1, wherein said sides are provided with openings to give access to an animal.

3. Animal handling apparatus as claimed in claim 2, wherein said openings are closable.

4. Animal handling apparatus as claimed in claim 1, wherein the floor supports two doors or gates, each normally substantially in line with a respective one of said sides and at the other end of the animal cage, said doors or gates being mounted to pivot to provide access to that part of the animal at said other end.

5. Animal handling apparatus as claimed in claim 1, wherein the floor supports a closable door or gate adjacent the other end of the animal cage through which the animal can egress.

6. Animal handling apparatus as claimed in claim 1, in combination with a race for leading animal to said one end when the animal cage is in a particular relatively rotated orientation with respect to said substantially vertical axis.

7. Animal handling apparatus as claimed in claim 6, wherein said vertical axis is centrally located with respect to the floor such that the animal can pass in one direction through the race into the animal cage and be turned 180° about said vertical axis and egress into the race in the opposite direction.

8. Animal handling apparatus as claimed in claim 1, wherein said means for holding an animal includes a support movable generally transversely of the animal cage and adapted to force an animal against one of said sides and to support the ventral region of an animal as the animal cage is pivoted about said substantially horizontal axis.

9. Animal handling apparatus as claimed in claim 8, wherein said support has first and second actuating mechanisms for moving it generally transversely of the animal cage and wherein the first mechanism comprises a foot operated pedal which, when released, frees the support against forcing an animal against one of said sides and the second mechanism comprises means for maintaining an animal forced against said one of said sides without operator assistance.

* * * * *